US009611094B1

(12) United States Patent
Cooper

(10) Patent No.: US 9,611,094 B1
(45) Date of Patent: Apr. 4, 2017

(54) WASTE RECEPTACLE HAVING FALSE BOTTOM

(71) Applicant: Rubicon Global Holdings, LLC, Atlanta, GA (US)

(72) Inventor: Ryan Cooper, Mars Hill, CA (US)

(73) Assignee: Rubicon Global Holdings, LLC, Atlanta, GA (US)

( * ) Notice: Subject to any disclaimer, the term of this patent is extended or adjusted under 35 U.S.C. 154(b) by 0 days.

(21) Appl. No.: 15/208,068

(22) Filed: Jul. 12, 2016

(51) Int. Cl.

| | |
|---|---|
| ***B65F 1/06*** | (2006.01) |
| ***B65F 1/08*** | (2006.01) |
| ***B07B 13/00*** | (2006.01) |
| ***B65F 1/14*** | (2006.01) |

(52) U.S. Cl.
CPC ..... *B65F 1/06* (2013.01); *B65F 1/1473* (2013.01); *B65F 2250/114* (2013.01); *B65F 2250/12* (2013.01)

(58) Field of Classification Search
CPC .. B65F 1/06; B65F 1/08; B65F 1/1473; B65F 2210/132; B65F 2210/176; B65F 2250/12; B65F 2250/1146; Y10S 220/909; Y10S 220/913; Y10S 220/9081; B07B 13/00; B62B 2202/20; B65B 67/1238
See application file for complete search history.

(56) References Cited

U.S. PATENT DOCUMENTS 5,031,796 A * 7/1991 Schafer ..... B65F 1/14 220/371
2013/0056373 A1* 3/2013 Benson ..... D06F 95/002 206/278
2014/0352054 A1* 12/2014 Tollasepp ..... A47J 47/20 4/654

* cited by examiner

*Primary Examiner* — Bryan Evans
(74) *Attorney, Agent, or Firm* — Finnegan, Henderson, Farabow, Garrett & Dunner, LLP

(57) ABSTRACT

A receptacle is disclosed for containing waste. The waste receptacle may include a container having a side surface connected to, surrounding, and extending normal to a lower surface. The waste receptacle may also include a false bottom disposed inside the container and having a rigid plate-like body, and a flexible liner connected to a perimeter of the rigid plate-like body. The flexible liner may extend toward an opening of the container. The waste receptacle may further include at least one support configured to support the false bottom a distance away from the lower surface of the container.

19 Claims, 1 Drawing Sheet

WASTE RECEPTACLE HAVING FALSE BOTTOM

TECHNICAL FIELD

The present disclosure relates generally to a waste receptacle and, more particularly, to a waste receptacle having a false bottom.

BACKGROUND

Conventional waste receptacles are available in many different configurations and sizes. For example, some waste receptacles are generally cylindrical and straight, while other waste receptacles are generally rectangular and tapered. In addition, some receptacles come equipped with wheels for easier transport, and/or handles for use in tipping and lifting. Regardless of the configuration, conventional waste receptacles can be purchased and/or leased in standard sizes ranging from a few quarts to hundreds of gallons.

Although conventional waste receptacles can be used in many different ways and for many different purposes, the fixed configuration and size of each conventional waste receptacle can present difficulties for the user. For example, some conventional waste receptacles selected for their larger size may be too deep for certain applications, requiring the user to bend and/or reach into the receptacle to remove waste. In other instances, the larger conventional waste receptacles may be so large that, when filled with relatively dense waste, the receptacle can be too heavy to move or empty. In yet other instances, waste fluid may collect at a bottom of a conventional waste receptacle, creating a sanitation issue and making emptying and cleaning of the receptacle difficult.

The disclosed waste receptacle is directed to overcoming one or more of the problems set forth above and/or other problems of the prior art.

SUMMARY

In one aspect, the present disclosure is directed to a false bottom for a waste receptacle. The false bottom may include a rigid plate-like body configured for insertion into the waste receptacle. The false bottom may also include a flexible liner connected to a perimeter of the rigid plate-like body. The flexible liner may extend in a direction normal to the rigid plate-like body.

In another aspect, the present disclosure is directed to a container for a waste receptacle. The container may include a lower surface, and a side surface connected to, surrounding, and extending normal to the lower surface. The container may further include at least one support configured to support a false bottom a distance away from the lower surface.

In yet another aspect, the present disclosure is directed to a waste receptacle. This waste receptacle may include a container having a side surface connected to, surrounding, and extending normal to a lower surface. The waste receptacle may also include a false bottom disposed inside the container and having a rigid plate-like body, and a flexible liner connected to a perimeter of the rigid plate-like body. The flexible liner may extend toward an opening of the container. The waste receptacle may further include at least one support configured to support the false bottom a distance away from the lower surface of the container.

DETAILED DESCRIPTION

Figure 1:
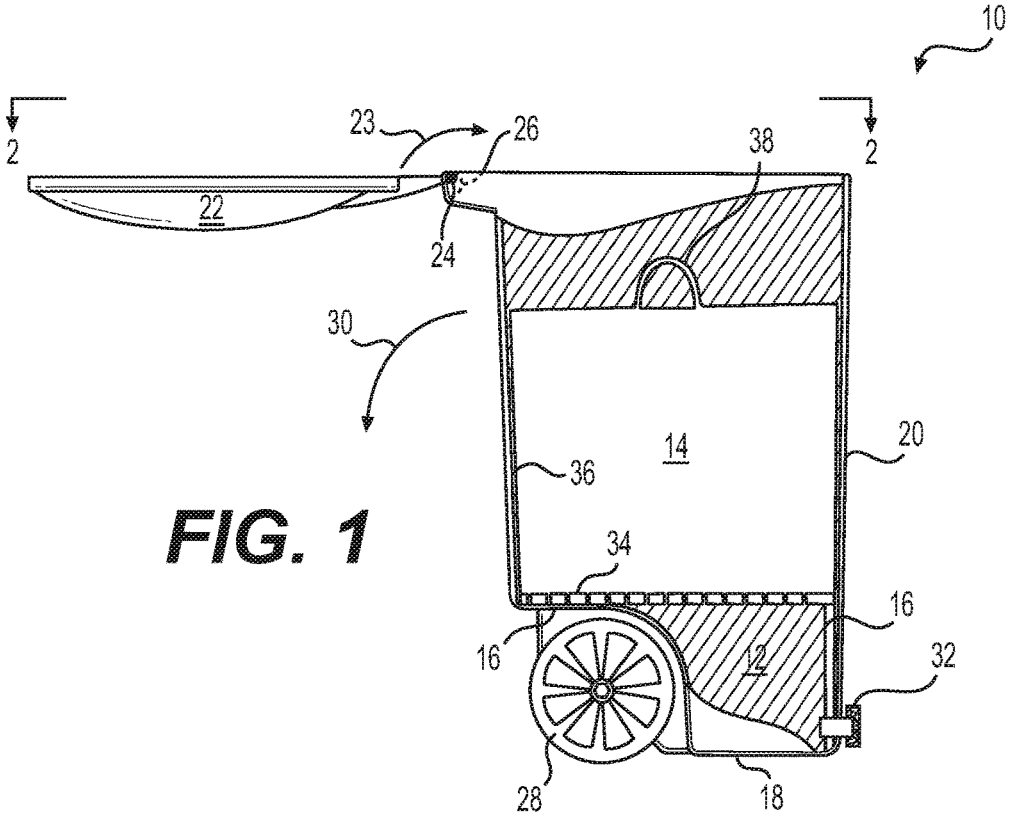
FIG. 1 is a cutaway view illustration of an exemplary disclosed waste receptacle.
Figure 2:
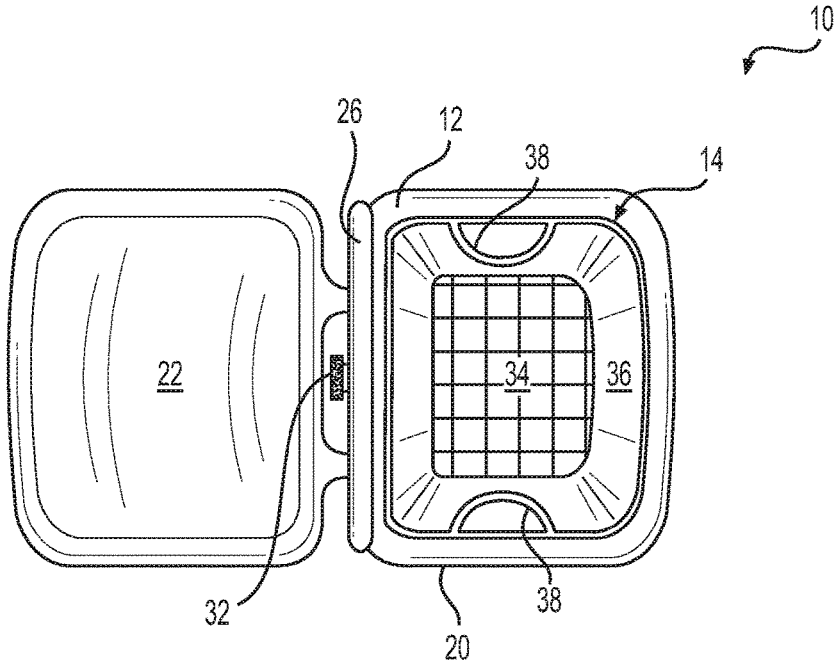
FIG. 2 is a top view illustration of the waste receptacle of FIG. 1.

FIGS. 1 and 2 illustrate an exemplary waste receptacle 10. Waste receptacle 10 may be an assembly of components including, among other things, a container 12, a false bottom 14, and a support 16 configured to provide support for false bottom 14. False bottom 14 and support 16 may be received inside of container 12 and, as will be described in more detail below, used to adjust a configuration of waste receptacle 10.

Container 12 may be a generally enclosed vessel made from a lower surface 18 and a side surface 20 that surrounds a perimeter of lower surface 18 and extends upward in a normal direction away from lower surface 18. In the disclosed embodiment, lower surface 18 and side surface 20 are integral with each and formed from a plastic material. For example, lower surface 18 and side surface 20 may be formed via a roto-molding or injection-molding process. It is contemplated, however, that lower surface 18 and/or side surface 20 could alternatively be made from another mater (e.g., metal) and/or by another process (e.g., deep draw, stamping/welding, etc.). In the disclosed example, container 12 may be generally rectangular (See FIG. 1), with a square or rectangular cross-section (see FIG. 2). It is contemplated, however, that container 12 could be tapered (e.g., have a smaller cross-section at lower surface 18) and/or have a circular cross-section. Side surface 20 may have an open end located opposite lower surface 18, the open end providing access to an interior of container 12.

The disclosed embodiment of container 12 includes additional features that increase a functionality of waste receptacle 10. In particular, a lid 22 may be provided to close off the open end of side surface 20. In one example, lid 22, having a cross-sectional shape similar to that of side-surface 20, is pivotally connected (e.g., via a hinge 24) to an upper edge of side surface 20 at a first side of container 12. This configuration may allow lid 22 to be selectively pivoted about hinge 24 in a direction represented by an arrow 23 to overlap and thereby cap off the open end of side surface 20. It is contemplated, however, that lid 22 could alternatively be disconnected from side surface 20 (i.e., that hinge 24 could be omitted) and selectively placed over the open end of side surface 20 to cap off container 12. A handle 26 may be connected to or otherwise formed at hinge 24, allowing manipulation (e.g., lifting, pulling, tilting, etc.) of waste receptacle 10. Likewise, one or more wheels 28 may be formed at the same side of container 12 as hinge 24 and handle 26, but at an opposite end (i.e., at an intersection of lower and side surfaces 18, 20). In this location, pulling of handle 26 in a direction away from container 12 may cause waste receptacle 10 to pivot about wheel(s) 28 in a direction represented by an arrow 30. It is contemplated, however, that non-tilting configurations (e.g., four-wheel configurations) may also be used, if desired.

In some embodiments, container 12 may include a drain 32 that allows waste fluids collected inside of waste receptacle 10 to be removed in an easy and sanitary manner. Drain 32 is shown in FIG. 1 as being located at (e.g., on or near) a lower edge of side surface 20 and at a side of container 12 opposite wheel(s) 28. However, it is contemplated that drain 32 could alternatively or additionally be located at the same side of container 12 as wheel(s) 28 (see FIG. 2) or located within lower surface 18. By locating drain 32 at the same side of container 12 as wheel(s) 28, the tilting of waste receptacle 10 in the direction of arrow 30 would cause any waste fluid inside of container 12 to move toward drain 32 for more complete emptying of waste receptacle 10.

False bottom 14 may be selectively used to adjust a depth and/or volume of waste receptacle 10, while also providing improved sanitation. False bottom 14 may include, among other things, a rigid plate-like body 34, and a rigid or flexible liner 36 that is connected to a perimeter of body 34. Liner 36 may extend upward away from body 34 in a normal direction. In one embodiment, body 34 is made from a plastic material, while liner 36 is made from a rubber material. It is contemplated, however, that body 34 and liner 36 could be made from the same material and/or a not plastic or rubber material. Body 34 may be rigid enough to keep body 34 in place while supporting a load of waste material placed into receptacle 10. In the disclosed embodiment, liner 36 is permanently bonded (e.g., chemically and/or thermally bonded) to the perimeter of body 34, although separate components are also envisioned.

In the disclosed embodiment, body 34 of false bottom 14 is porous. For example, body 34 may be fabricated as grid of intersecting ribs with spacing therebetween (see FIG. 2). In another example, holes may be drilled through or otherwise formed within body 34. The porosity of body 34 may be designed to allow waste fluid to pass through body 34, while simultaneously inhibiting larger debris (e.g., debris having an area greater than the spacing between the ribs and/or the drilled holes) from passing through. It is contemplated that body 34 could be solid, in some applications.

In the disclosed embodiment, liner 36 is impermeable, thinner than body 34, and configured to generally conform to an interior shape of container 12. It is contemplated, however, that in other embodiments, liner 36 could be permeable to facilitate a lower weight and/or additional draining functionality, if desired. Liner 36 may function as an easily cleanable and durable barrier that keeps waste material away from side surface 20. Although liner 36 may be configured to extend from body 34 to the upper edge of side surface 20, it is contemplated that liner 36 may have any height. In an exemplary embodiment, one or more handles 38 (e.g., two handles 38 at opposing sides) may be connected to liner 36 at an end opposite body 34. Handle(s) 38 may be used to remove false bottom 14 from container 12.

Support 16 may be configured to support false bottom 14 at a particular height inside container 12. In one example, support 16 is an integral portion of container 12. In particular, support 16 could be a molded feature protruding inward (see left support 16 shown in FIG. 1) into the space inside container 12. In this example, body 34 of false bottom 14 may rest on an upper surface of the protruding feature. In some embodiments, the molded feature may additionally function to provide a recess in which wheel(s) 28 can be located. Support 16 could also form a portion of false bottom 14, in some embodiments. For example, support 16 could be a leg member (e.g., an integral false bottom component or a separate component—see right support 16 shown in FIG. 1) that extends downward from body 34 to engage lower surface 18 of container 12. It may also be possible for support 16 to comprise both integrally molded features of container 12 and one or more leg members.

INDUSTRIAL APPLICABILITY

The disclosed waste receptacle 10 may provide greater versatility and sanitation for the user. In particular, the disclosed false bottom 14 may be used to reduce a depth and/or volume of the associated container 12. In addition, the disclosed support 16 may provide a foundation for false bottom 14 and, in some embodiments, may be adjusted (e.g., replaced with a different supports 16 of differing length leg members) to provide for multiple height levels. Further, the disclosed liner 36 of waste receptacle 10 may improve the cleanliness of the associated container 12, while the disclosed drain 32 may provide a way to dispose of waste fluids with improved sanitation.

It will be apparent to those skilled in the art that various modifications and variations can be made to the disclosed waste receptacle. Other embodiments will be apparent to those skilled in the art from consideration of the specification and practice of the disclosed waste receptacle. It is intended that the specification and examples be considered as exemplary only, with a true scope being indicated by the following claims and their equivalents.

What is claimed is:

1. A false bottom for a waste receptacle, comprising:

a rigid plate-like body configured for insertion into the waste receptacle; and a liner connected to a perimeter of the rigid plate-like body, the liner extending in a direction normal to the rigid plate-like body, wherein the false bottom is supported by selectively replaceable leg members of differing lengths configured to support the rigid plate-like body at multiple distances away from the lower surface of the waste receptacle, and wherein the false bottom is further configured as removable from the waste receptacle.

2. The false bottom of claim 1, wherein:

the rigid plate-like body is fabricated from plastic; and the liner is flexible and fabricated from rubber.

3. The false bottom of claim 1, wherein the liner is permanently bonded to the rigid plate-like body.

4. The false bottom of claim 1, wherein:

the rigid plate-like body is porous; and the liner is impermeable.

5. The false bottom of claim 1, further including at least one handle located at an end of the liner opposite the rigid plate-like body.

6. The false bottom of claim 1, wherein the rigid plate-like body is thicker than the liner.

7. The false bottom of claim 1, wherein the selectively replaceable leg members extend from the rigid plate-like body in a direction opposite the liner.

8. A container for a waste receptacle, comprising:

a lower surface;

a side surface connected to, surrounding, and extending normal to the lower surface and a rigid-plate like body of a false bottom; and selectively replaceable leg members of differing lengths configured to support the rigid plate-like body of the false bottom at multiple distances away from the lower surface of the container, wherein the false bottom is further configured as removable from the waste receptacle.

9. The container of claim 8, further including a drain disposed within the side surface.

10. The container of claim 9, wherein:

the selectively replaceable leg members each include an upper face engageable by the false bottom; and the drain is located between the lower surface and the upper face.

11. The container of claim 10, further including at least one wheel located at an intersection of the lower surface and the side surface, wherein the drain is located at a same side of the container as the at least one wheel.

12. The container of claim 11, further including a handle connected to an upper edge of the side surface opposite the lower surface, wherein the handle is located at the same side of the container as the at least one wheel and the drain.

13. The container of claim 10, further including a handle connected to an upper edge of the side surface opposite the lower surface, wherein the drain is located at a same side of the container as the handle.

14. A waste receptacle, comprising:

a container having a side surface connected to, surrounding, and extending normal to a lower surface;

a false bottom disposed inside the container and having a rigid plate-like body, and a liner connected to a perimeter of the rigid plate-like body, the liner extending in a direction normal to the rigid plate-like body and toward an open end of the container; and selectively replaceable leg members of differing lengths configured to support the rigid plate-like body at multiple distances away from the lower surface of the container, wherein the false bottom is further configured as removable from the waste receptacle.

15. The waste receptacle of claim 14, wherein:

the rigid plate-like body of the false bottom is porous and fabricated from plastic;

the liner of the false bottom is flexible, impermeable, and fabricated from rubber; and the liner is permanently bonded to the rigid plate-like body.

16. The waste receptacle of claim 14, wherein the liner includes at least one handle located at an end opposite the rigid plate-like body.

17. The waste receptacle of claim 14, further including a drain disposed within the side surface of the container between the lower surface and the false bottom.

18. The waste receptacle of claim 17, further including at least one wheel connected to the container at an intersection of the lower surface and the side surface, wherein the drain is located at a same side of the container as the at least one wheel.

19. The waste receptacle of claim 18, further including a handle connected to an upper edge container at the same side as the at least one wheel and the drain.

* * * * *